United States Patent [19]

Stokes

[11] 4,344,732

[45] Aug. 17, 1982

[54] SYSTEM FOR HANDLING HEAVY AND UNWIELDY VEHICLES

[76] Inventor: Charlie M. Stokes, P.O. Box 1963, Auburn, Ala. 36830

[21] Appl. No.: 117,643

[22] Filed: Jan. 29, 1980

[51] Int. Cl.[3] ..... B66F 9/12

[52] U.S. Cl. ..... 414/607; 180/14 R; 414/608

[58] Field of Search ..... 414/458, 459, 607, 608, 414/912, 719, 390, 391, 392, 399; 212/233; 280/47.18, 47.19, 47.35, DIG. 8; 254/89 R, 89 H; 172/814; 180/14 R

[56] References Cited

U.S. PATENT DOCUMENTS

| | | | |
|---|---|---|---|
| 2,958,508 | 11/1960 | Martinez | 254/89 H |
| 3,090,494 | 5/1963 | Thiele | 414/607 X |
| 3,522,895 | 8/1970 | Stokes | 414/608 |
| 3,572,444 | 3/1971 | Scholl et al. | 180/14 R X |
| 3,734,326 | 5/1973 | Esser | 414/719 X |
| 3,929,242 | 12/1975 | Sawyer | 414/458 |
| 4,096,961 | 6/1978 | Rocco | 180/14 R X |

FOREIGN PATENT DOCUMENTS

| | | | |
|---|---|---|---|
| 850474 | 9/1970 | Canada | 414/607 |

*Primary Examiner*—James L. Rowland

[57] ABSTRACT

A system for handling heavy and unwieldy vehicles which may have transporting wheels permanently affixed thereto or detachable therefrom with the system including a unique large forklift capable of lifting the vehicle from one surface to another surface at a different elevation. Lifting devices other than the unique forklift may be utilized to lift and move heavy and unwieldy vehicles with the vehicles including special points or areas which can be used for lifting and moving the vehicle with the vehicle also having components capable of being stacked one component on top of another by the lifting device, such as the forklift, with the entire stack then being lifted and moved by the lifting device, such as the forklift. The large forklift for lifting the heavy and unwieldy vehicle incorporates two or more machines which are connected together by suitable connecting means so that they can be disconnected from the connecting means enabling their use as individual machines. The lifting device is capable of lifting other vehicles than those disclosed or other loads especially when using a pallet attached to the lift forks and the machine or machines used for purposes other than lifting. Various types and combinations of machines may be used to form the lift device and commercially available steering and control arrangements can be used to enable a single operator to operate the lift device.

9 Claims, 13 Drawings Figures

SYSTEM FOR HANDLING HEAVY AND UNWIELDY VEHICLES

BACKGROUND OF THE INVENTION

1. Field of the Invention

The present invention generally relates to handling of heavy and unwieldy vehicles by a lifting device such as a large forklift incorporating two machines interconnected by a connector which enables the machines to be used separately or in pairs to form a large forklift to handle the vehicle which may have a cargo or other components permanently or detachably connected thereto, transporting wheels permanently or detachably connected thereto, the capability of being stacked and provided with special features facilitating association of the large forklift or other lifting device therewith to facilitate the handling of the heavy and unwieldy vehicle.

2. Disclosure Statement

Forklifts and other load handling equipment have been utilized to handle various types of loads with my prior U.S. Pat. No. 3,522,895, issued Aug. 4, 1970, disclosing certain features in this field of endeavor. Additionally, the following U.S. patents disclose various aspects of devices for handling loads, connecting machines, and the like.

| | | | |
|---|---|---|---|
| Nos. | 2,531,694 | Nos. | 3,112,836 |
| | 2,613,836 | | 3,183,990 |
| | 2,656,942 | | 3,189,363 |
| | 2,703,659 | | 3,207,253 |
| | 2,715,971 | | 3,211,313 |
| | 2,756,073 | | 3,245,488 |
| | 2,787,971 | | 3,253,668 |
| | 2,816,675 | | 3,255,837 |
| | 2,906,405 | | 3,255,906 |
| | 2,937,879 | | 3,280,931 |
| | 2,956,699 | | 3,289,868 |
| | 2,968,490 | | 3,318,473 |
| | 2,972,430 | | 3,417,571 |
| | 3,014,604 | | 3,572,444 |
| | 3,062,309 | | 3,651,882 |
| | 3,083,852 | | |

SUMMARY OF THE INVENTION

An object of the present invention is to provide a system for handling heavy and unwieldy vehicles utilizing a large forklift or other load lifting and handling equipment for lifting the heavy and unwieldy vehicle from one surface to another at a different elevation.

Another object of the invention is to provide a system in accordance with the preceding object in which the vehicles may be provided with transporting wheels either permanently attached thereto or detachable therefrom with the vehicles including special points thereon to be used for lifting and moving the vehicles and certain components of the vehicles can be stacked one component on top of another and lifted as a unit with the cargo on the vehicles or components of the vehicles being permanently or detachably connected thereto.

A further object of the invention is to provide a system in accordance with the preceding objects in which the large forklift is in the form of a pair of machines connected together by a connector or connectors which can be detached to enable the machines to be operated as individual machines.

A further object of the invention is to provide a system in accordance with the preceding objects in which the heavy and unwieldy vehicles meet legal requirements for vehicles and cargo when they are moved over public roads with the vehicles being capable of being towed as a trailer or carried on a transporting device with the complete assembly of each vehicle as a unit meeting legal requirements for movement over public roads.

Still another important object of the present invention is to provide a system in accordance with the preceding objects in which the vehicles may carry various types of cargo which can be lifted and moved while a part of the vehicles by a forklift or other types of lifting devices with the vehicles being utilizable by the user with the cargo on or attached to the vehicles with various assembly and disassembly techniques being employed to handle the vehicles and various components thereof.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
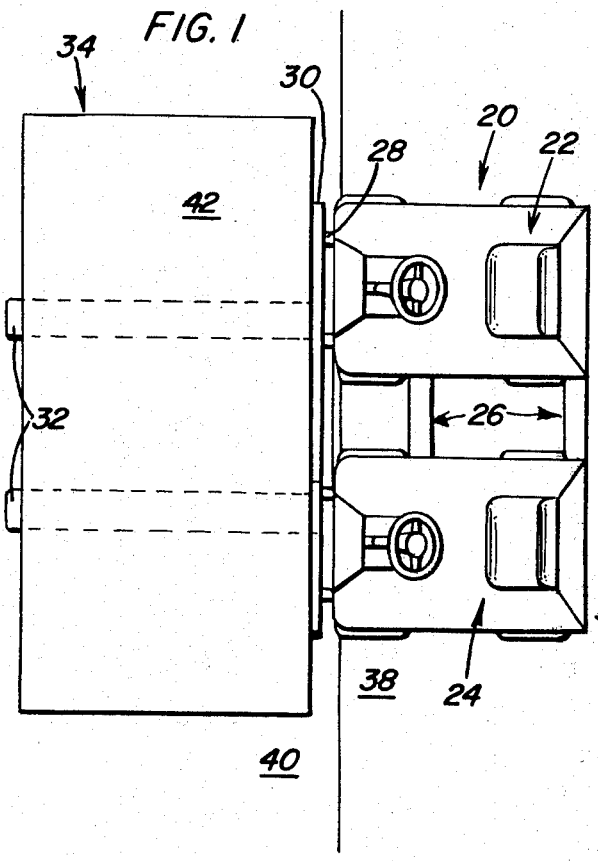
FIG. 1 is a plan view illustrating a large forklift formed by two machines connected together handling a heavy and unwieldy vehicle.
Figure 2:
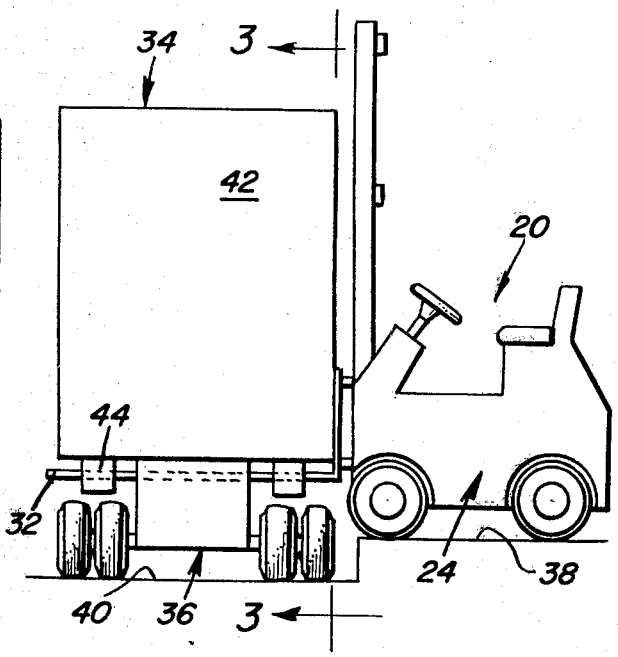
FIG. 2 is an end elevational view of the assembly of FIG. 1.

Referring now specifically to FIGS. 1 and 2, the lifting device is in the form of a large forklift generally designated by reference numeral 20 which is constructed by joining two or more machines 22 and 24 together by connectors 26 which may be detachably connected to the individual machines 22 and 24 in any suitable manner, such as by bolts, removable pins, and the like. The forward ends of the machines 22 and 24 are provided with lifting elements 28 interconnected by an attachment 30 having rigid, forwardly extending parallel forks 32 affixed thereto with the attachment 30 being separable from the lift elements 28 to enable the machines 22 and 24 to be independently used as individual machines.

The forklift 20 including the attachment 30 and the forks 32 are used to lift and move vehicle 34 and any cargo therein and any attachments 36 connected thereto. As pointed out, the forklift 20 is not limited for use only as a forklift since it may perform other functions which are facilitated by the two machines 22 and 24 being connected together.

As illustrated in FIG. 2, the forklift 20 is on one surface 38 while the vehicle 34 is supported from another surface 40 at a different elevation and the attachment 36, in the form of a wheel assembly, is being lifted while attached to the vehicle 34.

Figure 3:
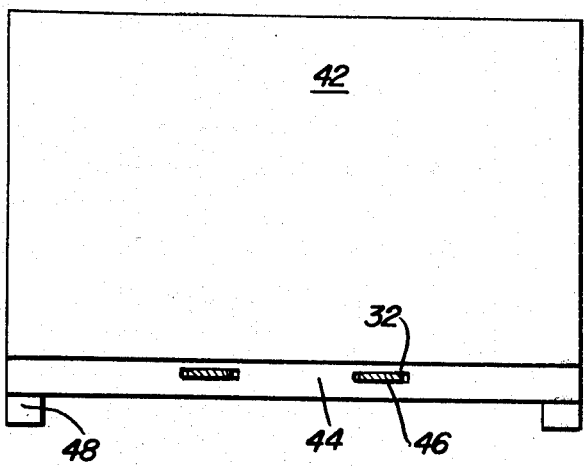
FIG. 3 is a side elevational view of the vehicle with the transporting wheels removed illustrating the association of the forklift forks with the removable component or cargo component of the vehicle.
Figure 4:
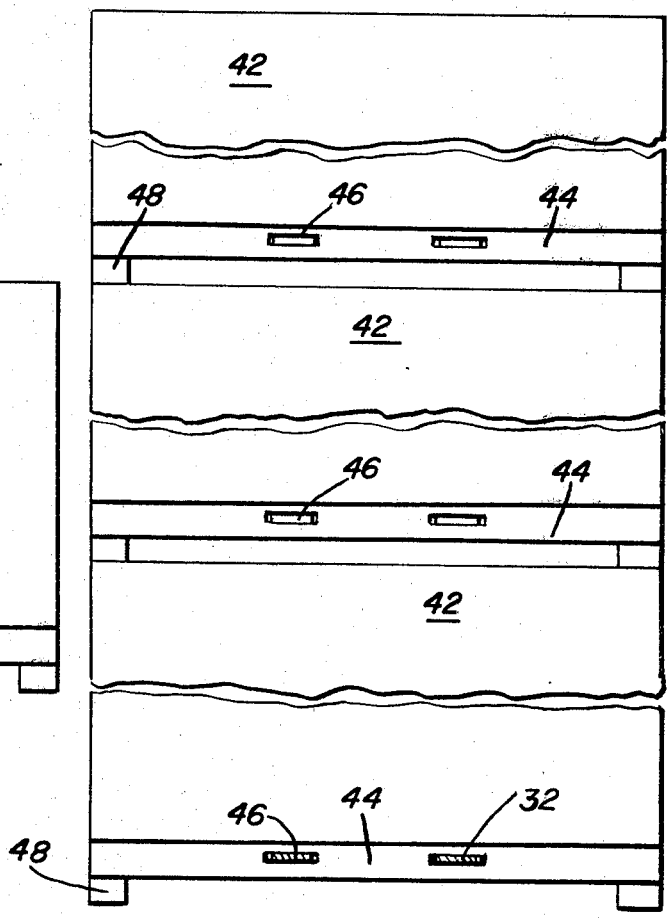
FIG. 4 is a side elevational view illustrating a plurality of components in accordance with FIG. 3 oriented in stacked relation.

FIG. 3 illustrates a component 42 of the vehicle 34 in the form of a body, cargo, or the like, having a longitudinal frame or frames 44 extending substantially throughout the length thereof and provided with openings 46 to receive the lifting forks 32 of the forklift 20 thereby enabling the component 42 to be moved in relation to the remainder of the vehicle 34. The frame 44 has sufficient strength to permit the component 42 and any cargo thereon or therein to be lifted and moved by the forklift 20 without damage to the component 42 and without damage to the cargo. In this embodiment, the component 42 has the frame 44 extending throughout the full length of the component 42. As illustrated in FIG. 4, the components 42 are stacked one on top of the other with the stacking and unstacking being accomplished by using the forklift 20 or other lifting devices. Projections 48 are detachably mounted on the frame 44 by any suitable means to facilitate stacking of a plurality of components 42. However, the components 42 can be stacked with or without projections 48 mounted thereon.

Figure 5:
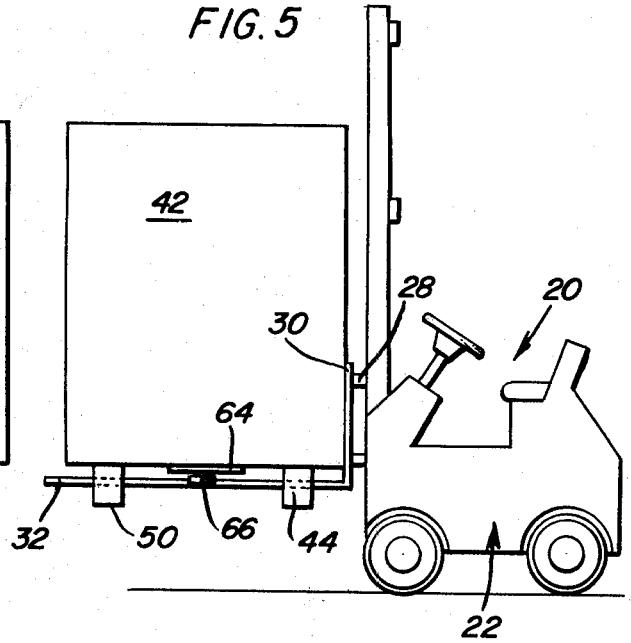
FIG. 5 is an end view of a component of a vehicle being lifted by a forklift with the transport wheels removed.

FIG. 5 illustrates an end view of a component 42 being lifted by the forklift 20 with the forks 32 extending through the openings 46 in the frame 44.

Figure 6:
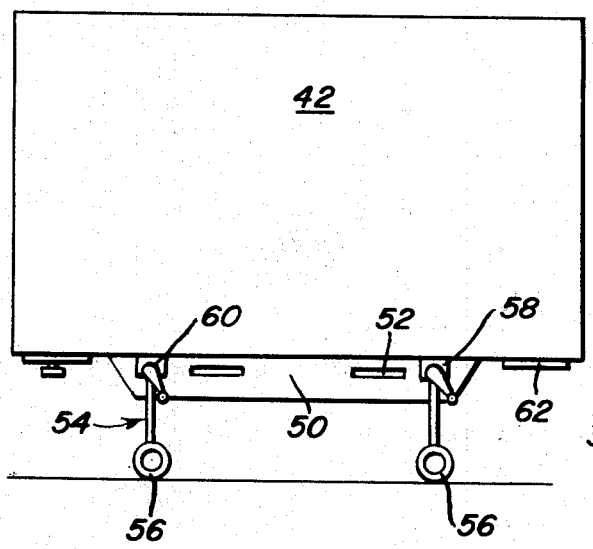
FIG. 6 is a side elevational view of a vehicle supported by attached supporting devices.

FIG. 6 illustrates a component 42 having a pair of short frames 50 mounted along the undersurface thereof with the frames 50 also including openings 52 for receiving the forks of the forklift 20. The frames 50 are provided with and supported by attached lifts 54 including support wheels 56 at the lower ends thereof with the upper ends thereof being supported by bracket structures 58 with a conventional winch mechanism 60 being provided to retain the wheels 56 in their lowered position as illustrated in FIG. 6 or in their upwardly folded condition alongside the frame members 50 when the component 42 becomes part of an over-the-road vehicle. This arrangement is somewhat similar to the landing wheels used on a semi-trailer. A bracket plate structure 62 is provided at the rear of the component 42 to which the transporting wheels 36 can be attached or it can be used to help to secure the component 42 to a supporting surface. At the forward end of the component 42, a fifth wheel pin mounting plate 64 and depending fifth wheel pin 66 is provided with the mounting plate 64 being also capable of aiding in the securement of the front of the component 42 to other supporting surfaces.

Figure 7:
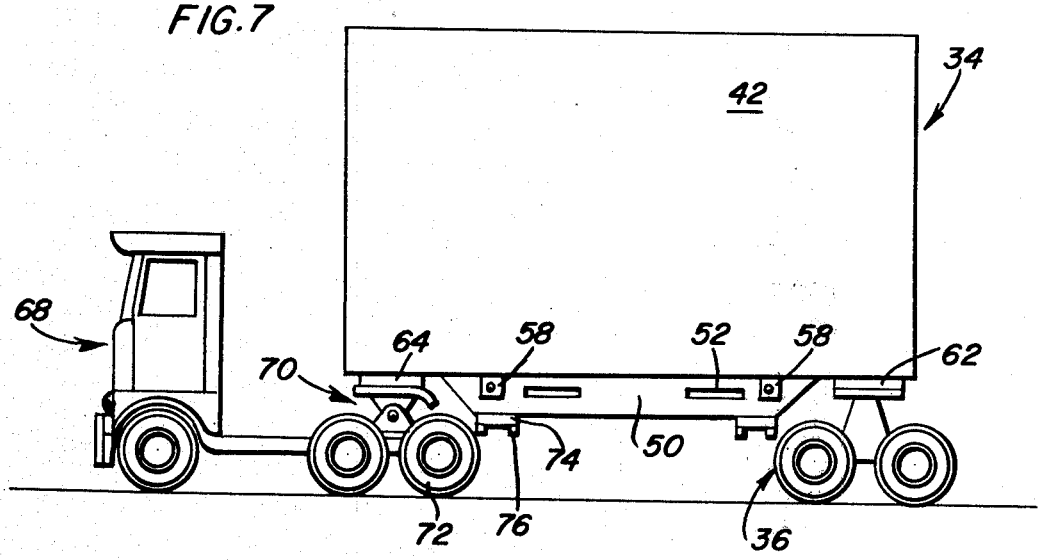
FIG. 7 is a side elevational view of a vehicle being towed by a truck illustrating various associated assemblies.
Figure 10:
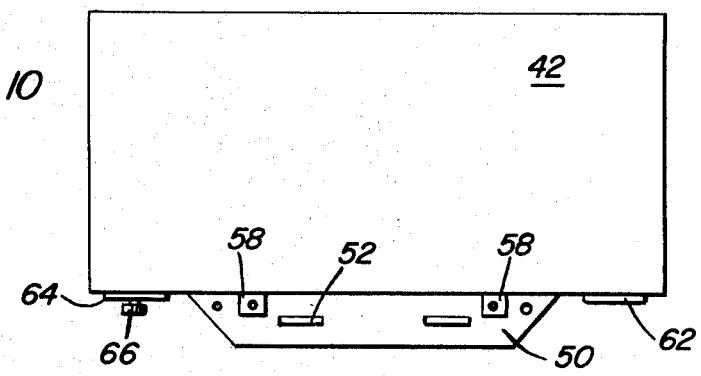
FIG. 10 is a side view of the vehicle with a short frame associated therewith.

FIG. 10 illustrates a side elevational view of the structure of FIG. 5 with the lifts 54 being removed and FIG. 7 illustrates the component 42 towed by a towing vehicle or truck generally designated by numeral 68 with the transporting wheel assembly 36 attached to the bracket plate structure 62 and the plate 64 and pin 66 are connected to the fifth wheel plate or assembly 70 on the towing vehicle or truck. It is noted that the short frames 50 do not extend into overlying relation to the wheel assembly 36 or the wheels 72 on the towing vehicle or truck. Also, in FIG. 7, the frame members 50 are interconnected by a transverse plate 74 adjacent each end of the bottom edge thereof with downward projections 76 adapted to receive the forks of a forklift. The plate 74 provide a reinforcement for the frame members and an alternative arrangement for receiving the forks of the forklift which may be spaced apart different distances depending upon the structure of the forklift. In other words, the forks may be placed between the projections 76 under the plates 74, placed inwardly of the plates 74 in engagement with the undersurfaces of the frame members or extended through the openings 52 in the frame members.

Figure 11:
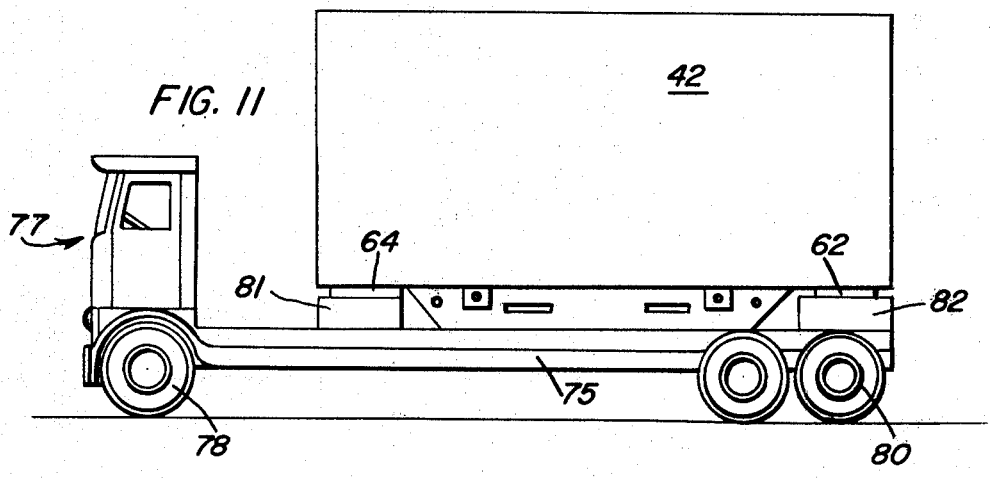
FIG. 11 is a side elevational view of the vehicle of FIG. 10 mounted on the chassis of a truck.

FIG. 11 illustrates the component or body 42 attached to the chassis 75 of a truck 77 which is conventional in that it includes front steerable wheels 78 and rear driving wheels 80 with the chassis 75 being adapted to support and secure the component 42 having the short frames 50, as illustrated in FIG. 10. The front of the component 42 is attached to the chassis 75 by a front chassis adapter 81 which receives and anchors the mounting plate 64 and pin 66 thereon. The rear of the chassis 75 secures the rear of the component 42 by using a chassis adapter 82 which connects with rear attaching plate 62 which is the same plate used to mount the transporting wheel assembly 36.

Figure 12:
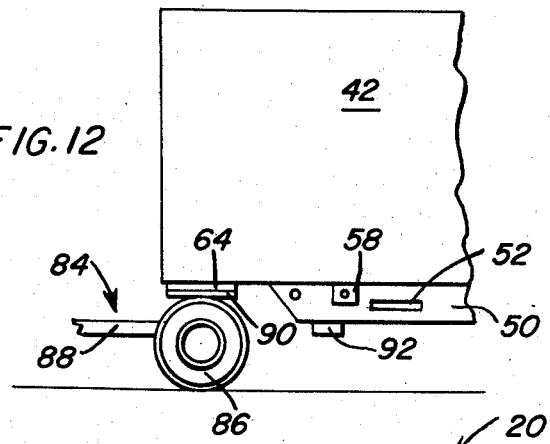
FIG. 12 is a fragmental side elevational view illustrating a vehicle having a non-propelling dolly under the forward end thereof.

FIG. 12 illustrates the forward end portion of the component 42 which is quite similar to the arrangement illustrated in FIG. 7, except that in this instance, the forward end of the component 42 is supported by a non-propelling dolly 84 having supporting wheels 86 and a forwardly extending tongue 88. The dolly 84 is provided with a fifth wheel plate 90 connected to the plate 64 and depending pin 66 thereon for connecting the dolly 84 to the component 42. The tongue 88 may be used to tow and guide the vehicle when assembled in the manner illustrated in FIG. 12 with the tongue 88 being connected to any suitable towing vehicle or other device. As in FIG. 7, the frame members 50 may have an opening 92 below the lower edge of the frame members 50 which may be in the form of a loop structure to form an opening or transverse plates with depending projections to facilitate handling of the vehicle by the forklift. The component 42 remains basically the same in all of its adaptations and uses illustrated in FIGS. 3–12 and may either have the long frame members 44 or the short frame member 50 associated therewith.

Figure 8:
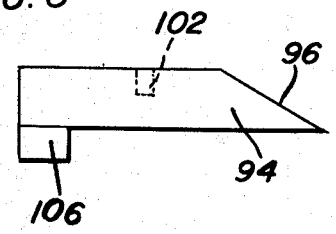
FIG. 8 is a side elevational view a front extension for the frame of the vehicle.
Figure 9:
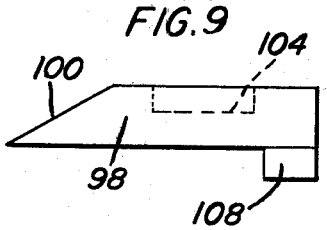
FIG. 9 is a side elevational view of a rear extension for the frame of the vehicle.

FIG. 8 illustrates a front extension frame member 94 having a bevelled end 96 conforming with the bevelled forward end of the short frame member 50 so that it will form an extension thereof and FIG. 9 illustrates a rear extension 98 having a corresponding inclined forward end 100 to conform with the rear inclined end of the short frame member 50. With these two extensions, the short frame members 50 may be converted to long frame members which extend throughout the length of the component 42 in the nature of the long frame members 44. The use of the extensions is advantageous when the components 42 are stacked. The front extension 94 includes an attachment socket or other means 102 for connecting the front extension 94 to the plate 64 or other attaching means and the rear extension 98 is provided with an attachment socket or arrangement 104 for connecting the rear extension 98 to the rear mounting plate 62 or other attaching means and each of the extensions is provided with a depending projection 106, 108 corresponding to the depending projections 48 on the long frame members. By using these extensions, the weight of the component 42 is distributed over a larger supporting area which enables the short frame members 50 to be converted to long frame members, similar to 44, when the components 42 are stacked. The projections 106 and 108 on the extensions 94 and 98 are detachably mounted thereon to enable optional removal as desired.

Figure 13:
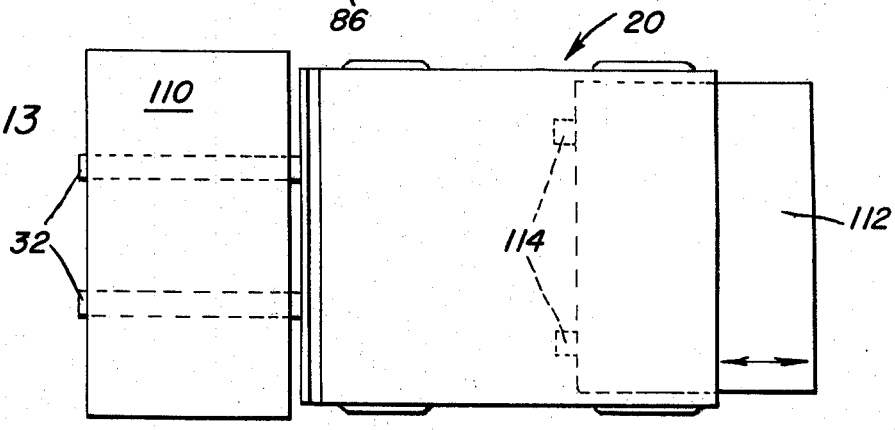
FIG. 13 is a plan view illustrating a forklift with a platform or pallet mounted thereon which can be placed under a vehicle and a counter weight associated therewith.

FIG. 13 illustrates a pallet or platform 110 that can be used to lift the vehicle, such as the vehicle 34 in FIGS. 1 and 2, with the forklift 20 being illustrated schematically and provided with lifting forks 32 extending through or under the pallet or platform 110 in a conventional manner. The pallet or platform 110 enables the weight of the vehicle 34 to be distributed over a larger area when being lifted and moved by the forklift 20. This is especially advantageous when moving vehicles 34 that are constructed with relatively weak frame members 44 or 50 under them. When using the pallet, the fifth wheel pin mounting plate 64 and pin 66 will prevent the vehicle from sliding in one direction while the transport wheels 36 will prevent the vehicle from sliding in the other direction in relation to the pallet. Also, illustrated schematically is a movable counterweight 112 mounted on the forklift 20 to reciprocate horizontally, as indicated by the directional arrow, so that it can move outwardly from the side or end of the forklift 20 opposite from the platform 110. Any suitable means may be provided to move the counterweight in a horizontal plane inwardly and outwardly so that as a load is being lifted by the forks 32, the counterweight can be moved outwardly to a desired extended position to enable the lifting system to be more stable. The counterweight is symmetrical with respect to the center line of the forklift to cause the center of gravity of the system to balance around a desired point. The capability of changing the center of gravity or balance the center of gravity is quite desirable when vehicles or loads of different weight are being lifted.

Various procedures may be employed for mounting and supporting the counterweight. For example, wheels which can be raised or lowered can be attached to the counterweight which will increase the stability of the forklift by helping to limit the amount of rocking of the over-all machine when it is raising and moving loads. Attachment points 114 may be provided on the counterweight for connecting the counterweight to the forklift so that it can move in a horizontal plane to change the center of balance or center of gravity of the over-all lifting system when the weight or size of load being lifted by this system is changed. The counterweight may also be pivotally connected to the forklift for movement between a retracted and extended position.

The drawings illustrate that the vehicle 34 or component 42 can be lifted by a forklift type of machine 20, but such lifting and handling is not limited to only forklifts for moving and lifting these items. The frame members 44 and 50 are provided to furnish a support for the uniform distribution of weight of the vehicle or component on them and to serve as a component for absorbing the force that is used to lift and move the vehicle 34 or component 42. The forklift 20 has the lifting capacity to handle heavy and unwieldy vehicles 34 or components 42 and is constructed by joining two or more machines 22 and 24 by the use of connectors 26 to form the large forklift. The large forklift 20 or the machine formed by joining the two machines together can be utilized for various other purposes. The individual or separate machines 22 and 24 are small enough to be moved over public roads. However, the large forklift 20 will be used on private property and, therefore, does not have to conform to size and weight requirements of machines that move over public roads.

The components 42 can be stacked one on top of the other with the stacking and unstacking being accomplished by using the forklift 20. In the embodiment of FIG. 6 where wheels are used on the lift devices 54, ground engaging plates or skids may be employed in lieu of the wheels 56.

The vehicle 34 or components 42 can be transported by land, water or air in any conventional type of conveyance. The configuration or shape of the vehicle or components is that which will satisfy the needs of the user, but they must meet the size and weight requirements that will permit it to be lifted and moved when cargo is part of the vehicle or component, but the cargo or items handled by the vehicle can be detachable from the vehicle or components thereof.

The vehicle 34 or component 42 can be self-contained, part of other equipment and may be attached to other supporting surfaces when it is being used as part of other equipment. Special lifting features, such as members 74 and 92, may be attached to the vehicle frame which provides additional lifting points, together with the openings in the frame members, to facilitate lifting with the forklift. These additional lifting features are optional since the forks of the forklift can get under the frame or under the attachments thereon or through the openings in the frame to lift and move the vehicle. The number of transporting wheels used with the vehicle 34 or the towing or transporting truck will be that number required to distribute the weight of the vehicle over the road surface and permit the user to comply with regulations relating to load limits which can be moved over public roads.

Other machines can be connected together to form the large lifting device 20 rather than the forklift type of machines 22 and 24 or a combination of forklifts and other machines can be connected with the connectors to form the device. Also, two or more machines can be connected together to form the large lift device which can be used for lifting objects other than vehicles and for purposes other than lifting. Commercially available steering and control attachments can be connected to the machines to enable one operator to handle the large lift device. Also, the lift device is capable of lifting other vehicles especially when the pallet is attached to the lifting forks.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination, a heavy and unwieldy load vehicle and means for lifting and moving the load vehicle, said load vehicle including means associated with the lower surface thereof by which the load vehicle can be lifted and moved, said means for lifting and moving the load vehicle comprising:

at least two independently maneuverable power driven vehicles interconnected in side-by-side relation to form a single unit, means detachably connecting the power driven vehicles together to enable independent use, a lifting assembly solely extending transversely of all of the vehicles forming the unit, spaced from the connecting means and connected to all of said power driven vehicles, a pair of lifting forks included in the lifting assembly and connected with all of the vehicles forming the unit for lifting and moving the load vehicle, said lifting assembly, said pair of lifting forks and said at least two power driven vehicles constituting said single unit operatively connected to form a large forklift to lift and manipulate the load vehicle from one surface to another at a different elevation and move the load vehicle from one location to another, and bottom frame means included in said load vehicle being provided with spaced slots receiving said pair of lifting forks, said bottom frame means distributing the weight of the load vehicle and a lifting force over a large area.

2. The structure as defined in claim 1 together with an attaching plate at the rear of the load vehicle for detachably mounting transport wheels or securing the load vehicle to other supporting, lifting and moving assemblies.

3. The structure as defined in claim 1 wherein said load vehicle includes a mounting plate and fifth wheel pin at the forward end thereof for connection with the fifth wheel plate of a towing vehicle or connection with other supporting, towing, lifting and moving assemblies.

4. The structure as defined in claim 1 wherein said frame means extends longitudinally below the load vehicle and optional attachments along the lower surface thereof for rigidifying the frame means and forming additional means for receiving and positioning the lifting forks.

5. The structure as defined in claim 1 wherein said load vehicle includes depending projections to facilitate stacking of components in vertically stacked superimposed relation.

6. The structure as defined in claim 1 wherein said load vehicle includes an attachable lift adjacent each end thereof and provided with wheels at the lower end for supporting the load vehicle.

7. The combination as defined in claim 1 together with adapter means on the unit separate from the connecting means to enable the unit to perform functions desired by a user.

8. The combination of claim 1 together with a pallet for distributing the weight of the load and the lifting force over said large area.

* * * * *

UNITED STATES PATENT AND TRADEMARK OFFICE

CERTIFICATE OF CORRECTION

PATENT NO. : 4,344,732

DATED : August 17, 1982

INVENTOR(S) : Charlie M. Stokes

It is certified that error appears in the above-identified patent and that said Letters Patent is hereby corrected as shown below:

Column 8, after line 32, insert the following:

--9. The structure as defined in claim 8 wherein said forklift includes a counterweight movable in a horizontal plane between retracted and extended positions in opposed relation to the pallet and load lifted by the lifting forks thereby balancing and stabilizing the forklift when handling the vehicle, said counterweight being symmetrical with respect to the center line of the forklift and pallet.--

Signed and Sealed this

*Sixteenth* Day of *August 1983*

[SEAL]

*Attest:*

GERALD J. MOSSINGHOFF

*Attesting Officer*

*Commissioner of Patents and Trademarks*